United States Patent [19]

Mintzer

[11] Patent Number: 5,010,462

[45] **Date of Patent: * Apr. 23, 1991**

[54] ILLUMINATION DEVICE FOR A HAND-HELD REMOTE CONTROL UNIT

[75] Inventor: Joseph H. Mintzer, Hartsdale, N.Y.

[73] Assignee: M.C.R. Farmer, Inc., Hartsdale, N.Y.

[ * ] Notice: The portion of the term of this patent subsequent to Jan. 9, 2007 has been disclaimed.

[21] Appl. No.: 462,064

[22] Filed: Jan. 8, 1990

Related U.S. Application Data

[63] Continuation-in-part of Ser. No. 179,744, Apr. 11, 1988, Pat. No. 4,893,222.

[51] Int. Cl.[5] ..... F21V 33/00

[52] U.S. Cl. ..... 362/109; 362/190; 362/253

[58] Field of Search ..... 362/190, 191, 109, 119, 362/157, 253, 120

[56] References Cited

U.S. PATENT DOCUMENTS 4,611,264 9/1986 Bradley ..... 362/191

4,893,222 1/1990 Mintzer ..... 362/109

*Primary Examiner*—Ira S. Lazarus

*Assistant Examiner*—Sue Hagarman

*Attorney, Agent, or Firm*—Hoffman & Baron

[57] ABSTRACT

An illumination device for use with a hand-held remote control unit having a length, width and height and a back panel and a front control panel. The illumination device comprises a base, and a projection extending from the base. The projection is exposed to a space formed above the base and contains an illumination source which is directed toward the space. An attachment system is also provided for releasably attaching at least a portion of the back panel of the hand-held remote control unit to at least a portion of the base, so that at least a portion of the length and width and the entire height of the hand-held remote control unit is maintained in a position within the space above the base, so as to subject a selected surface of the front control panel to the illumination source for facilitating illumination of the selected surface by reflecting light rays therefrom, while permitting actuation and operation of the hand-held remote control unit.

20 Claims, 6 Drawing Sheets

Fig. 1
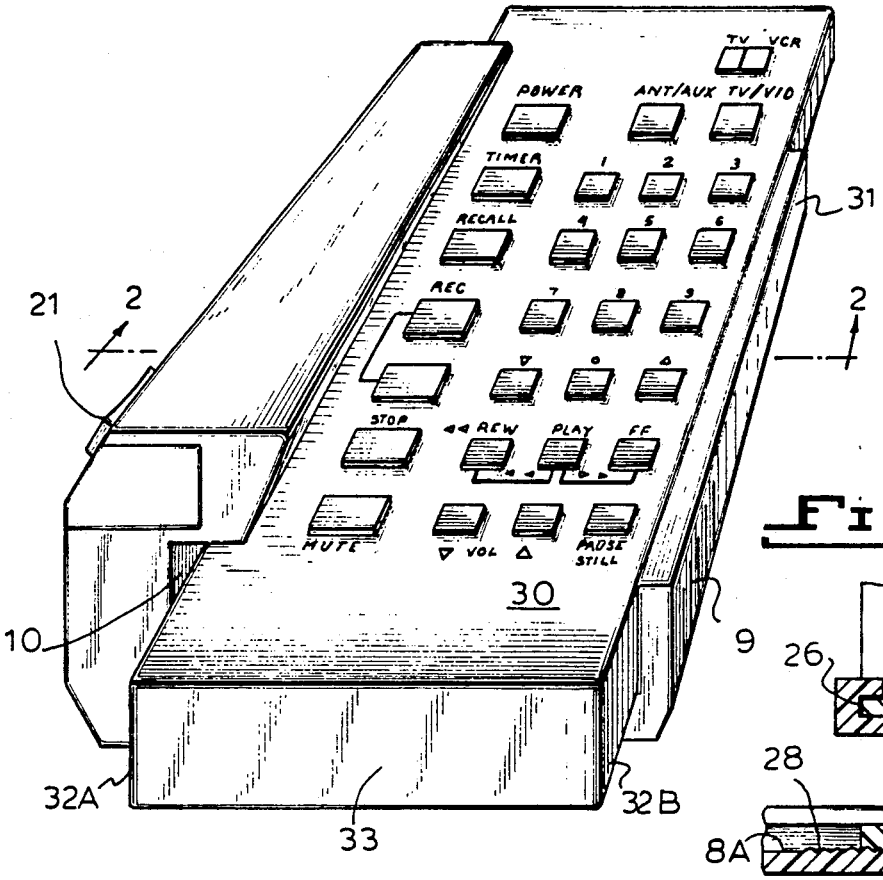
Fig. 1A
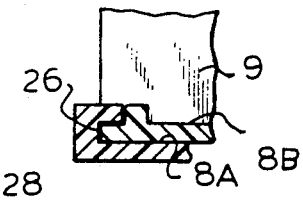
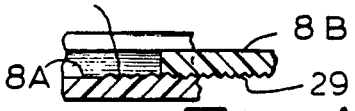
Fig. 1B
Fig. 2
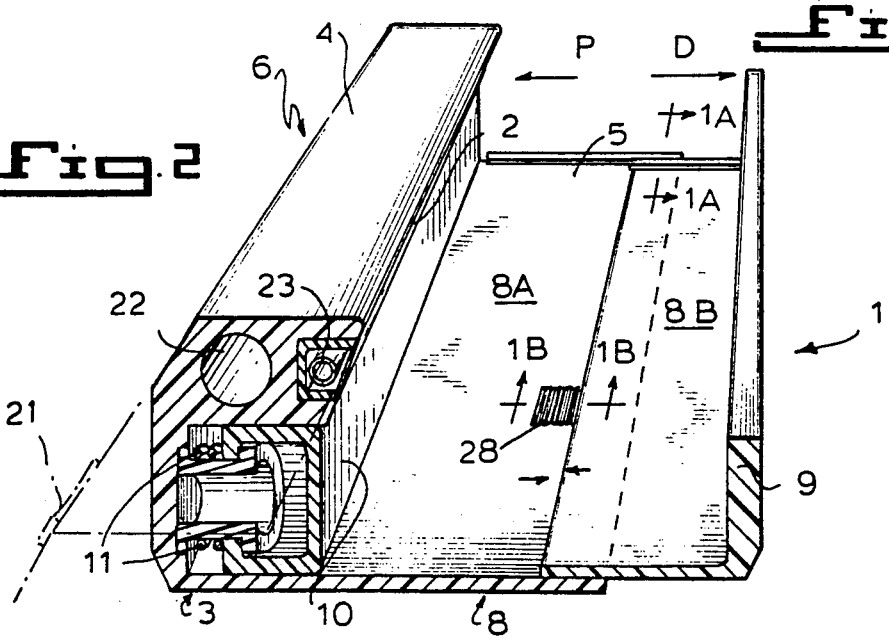

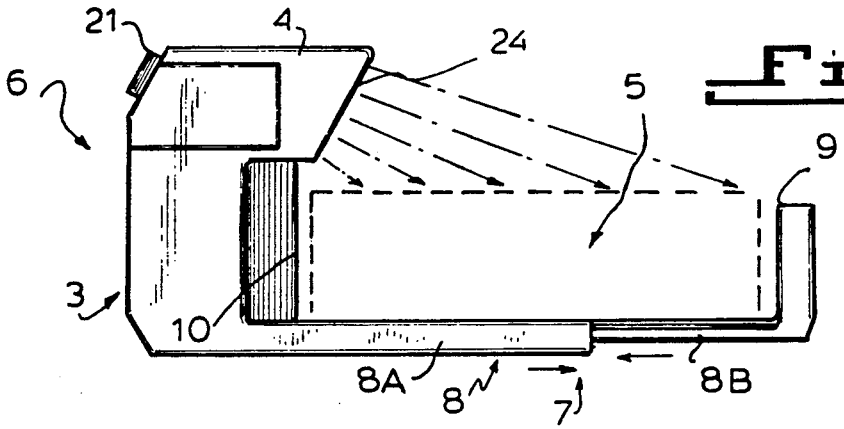
Fig. 3
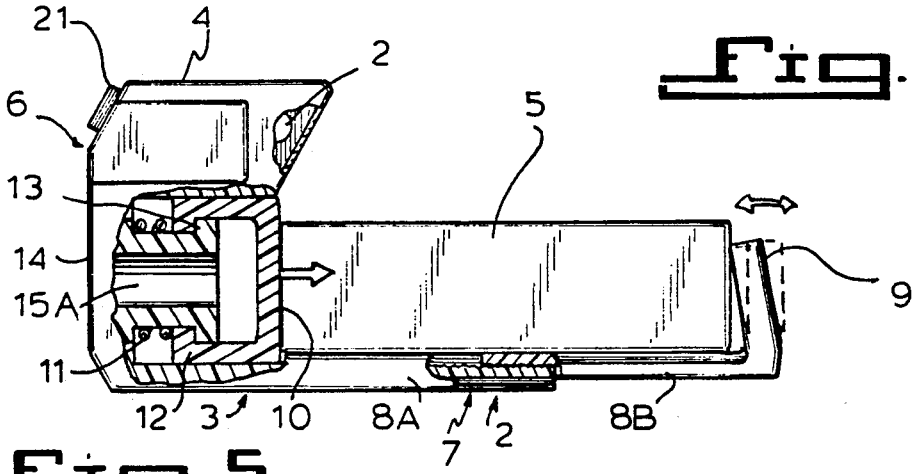
Fig. 4
Fig. 5
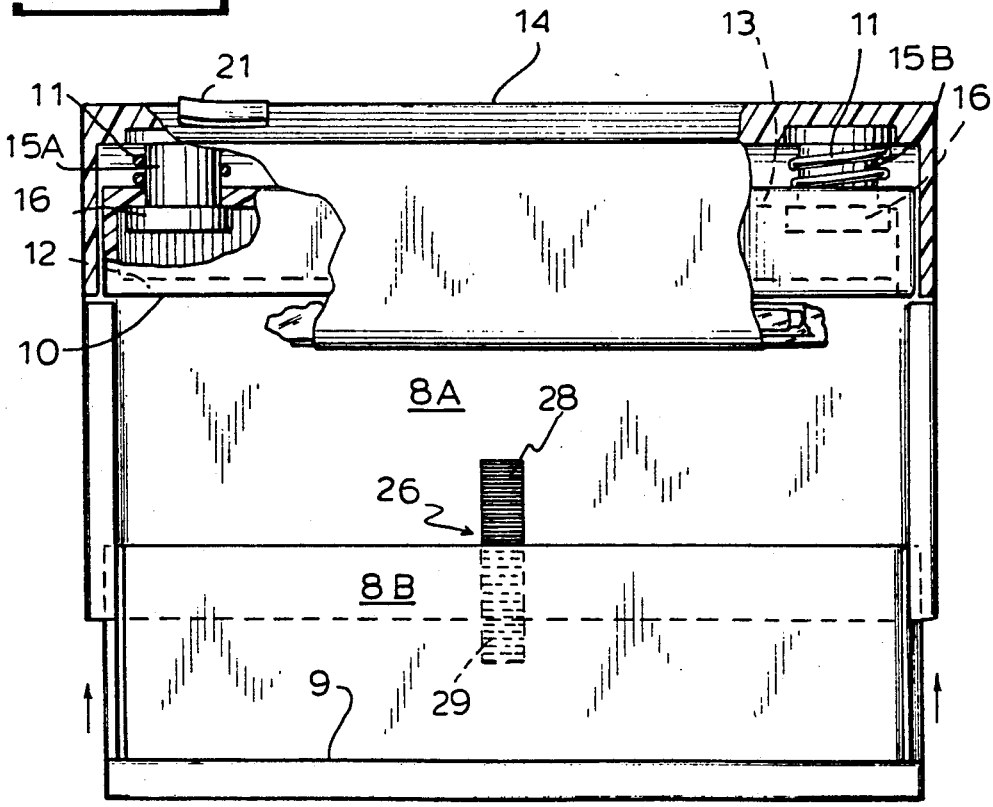

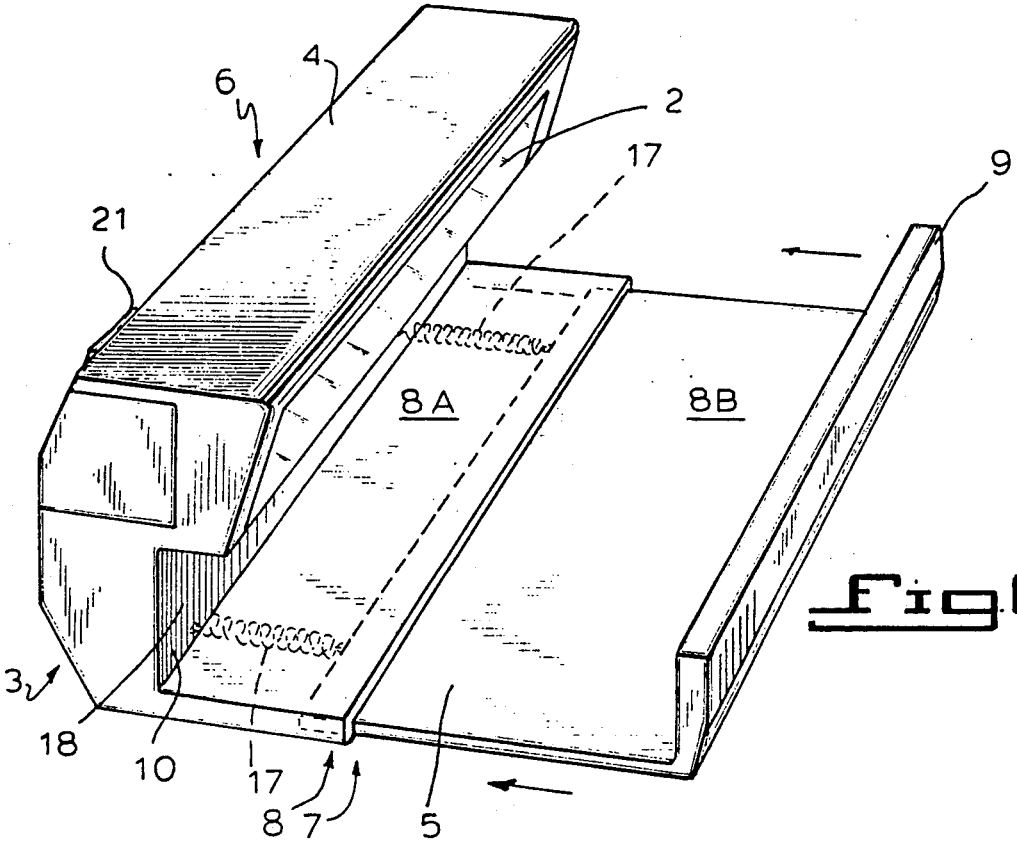
Fig. 6
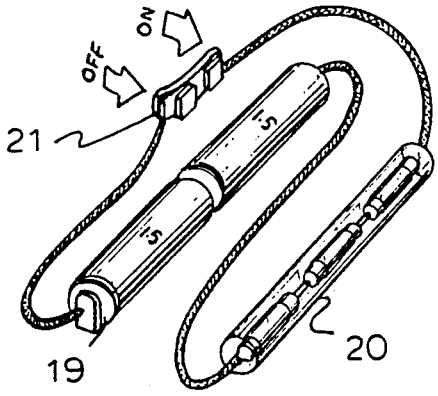
Fig. 12
Fig. 11
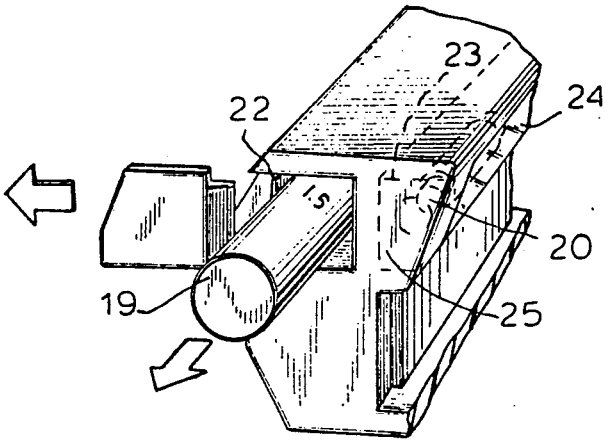

ILLUMINATION DEVICE FOR A HAND-HELD REMOTE CONTROL UNIT

This is a continuation-in-part of Ser. No. 179,744, filed on Apr. 11, 1988, now U.S. Pat. No. 4,893,222.

FIELD OF THE INVENTION

The present invention relates generally to illumination devices with hand-held holders therefor, and more particularly to illumination devices for attachment to the casing of a hand-held remote control unit used in connection with remotely controlling televisions, video cassette recorders (VCR), compact disc (CD) players and the like, in lowly illuminated environments.

BACKGROUND OF THE INVENTION

When viewing a television broadcast or video-taped movie, using a remote controlled television and/or VCR system, it is most common to operate the hand-held remote control unit in lowly illuminated environments, such as for example, in a darkened room. Such viewing conditions in general, appear to provide improved video images on the TV screen, as well as give the appearance of viewing video-taped movies and the like in a movie theatre.

Presently available hand-held remote control units are equipped with numerous programming and selection functions, including video-frame freezing, slow motion, auto-reverse, auto-forward, etc. As a result, it is most common for the front panels of such hand-held remote control units to bear numerous switches, often of membrane type, the number of which typically exceeds ten or more. In addition, each hand-held remote control unit contains a transmitter which usually transmits digitally encoded infrared light signals from its front side panel to a receiver which is usually contained within the television unit and/or the VCR unit.

While such hand-held remote control units have made television and video-tape viewing much more convenient and thus enjoyable as a result of such remotely controllable programming, recording and playback functions at the user's fingertips, a serious problem nevertheless arises when trying to operate such remote control units in highly desired, lowly illuminated environments. In particular, as a result of the low illumination levels in the viewing room, a television/video viewer with a hand-held remote control unit is incapable of seeing clearly all the programming and selection function switches, that is, without getting out of his or her chair and turning the lights on. This disruption in television viewing is very disturbing and greatly detracts from the viewing experience in general.

In view of this long-felt problem, there presently exist several portable illumination devices which have been designed for attachment to books in particular to facilitate night-time reading while sitting in bed or while sitting as a passenger in a car.

Examples of such prior art illumination devices can be found, for example, in U.S. Pat. Nos. 4,700,634; 4,598,340; 4,432,042; 3,885,145; 2,235,109; 2,161,872; and 2,395,760. However, each device described in these references is wholly unsuitable for facilitating illumination of the front panel of a hand-held remote control unit, while permitting actuation and operation of the hand-held remote control unit without hindrance and/or obstruction.

Accordingly, it is a primary object of the present invention to provide an illumination device for attachment to the casing of a hand-held remote control unit, regardless of its specific dimensions, and to provide a way to illuminate the front panel thereof bearing programming and function selection switches, and therewhile to allow for the unobstructed hand-held operation of the remote control unit.

Another object of the present invention is to provide such an illumination device which has an adjustable mounting means that is capable of adjustment so as to receive and securely hold one of a wide variety of hand-held remote control units having various physical dimensions.

Another object of the present invention is to provide such an illumination device which operates on battery cells, provides a powerful yet diffused beam of illumination to the front panel of the hand-held remote control unit, and can be held in one's hand in a manner similar to the hand-held remote control unit itself.

An even further object of the present invention is to provide such an illumination device which is both safe and simple to use, inexpensive to manufacture, and which can be fabricated in large part from light-weight, injection-molded modern plastics.

Other and further objects of the present invention will be explained hereinafter, and will be more particularly delineated in the appended claims, and other objects of the present invention will hereinafter become apparent to one with ordinary skill in the art to which the present invention pertains.

SUMMARY OF THE PRESENT INVENTION

The present invention is an illumination device for attachment to the casing of a hand-held remote control unit having a length, width and height and a back panel and a front control panel.

In general, the illumination device for use with a hand-held remote control unit comprises a base, a projection extending from the base, an illumination means, and an attachment means. The projection is exposed to a space formed above the base, and contains the illumination means which is directed toward the space. The attachment means is provided for releasably attaching at least a portion of the back panel of the hand-held remote control unit to at least a portion of the base so that at least a portion of the length and width and entire height of the hand-held remote control unit is maintained in a position within the space above the base, so as to subject a selected surface of the front control panel to the illumination means, for facilitating illumination of the selected surface while permitting actuation and operation of the hand-held remote control unit.

In the preferred embodiment, the projection and at least a portion of the base comprise a housing for containment of the illumination means. The housing has a surface permitting the passage of illumination from the illumination means through the surface, and at least a portion of the base comprises a receiving means for receiving the hand-held remote control unit within the space.

In the preferred embodiment, the base comprises a substantially planer support structure joined to the housing and has a distal end and a proximal end. The support base further has an inner end wall which is orthogonally disposed at the proximal end. In addition, the attachment means comprises at least one fastening device provided to the support base and back panel of the hand-held remote control unit, for releasably attaching the hand-held remote control unit to the base. Preferably, the fastening device comprises a first member attached to a portion of the substantially planar support structure, and a second member capable of attachment to a selected portion of the back panel of the hand-held remote control unit. The first and second members each have mating surfaces which are releasably attachable to each other upon being brought into contact, whereby the hand-held remote control unit is maintained in position within the space.

In the preferred embodiment, the first member comprises a strip of hook-type material securely attached to the portion of the substantially planar support structure, and the second member comprises a strip of loop-type material capable of being securely attached to the portion of the back panel of the hand-held remote control unit, such that when the strips of loop-type and hook-type material are brought into contact with each other, the hand-held remote control unit is maintained within the space above the base, so as to be illuminated by the illumination means.

Also, in order to utilize minimal hook and loop-type material, recesses can be formed within the substantially planar support structure of the base so as to retain the strips of loop-type and hook-type material employed in realizing the attachment means of the present invention, while releasably securing the bottom panel of hand-held remote control unit to the planar support structure, without wobbling.

In an alternative embodiment of the present invention, the attachment means is realized by one or more pairs of ferric and magnetic strips attached to the back panel of the hand-held remote control unit and the planar support structure of the illumination device, respectively.

Thus, the attachment means provided to the hand-held remote control unit and the base, ensures that the remote control unit will be securely held in the receiving space without risk of falling out upon subjection to normally expected impact forces occasioned during expected use.

The illumination means in general comprises a battery power source, a lamp unit, and an on-off switch, with the battery power source, lamp unit and switch being connected in a series configuration. In the preferred embodiment, the lamp unit comprises three fuse-type incandescent bulbs connected in series configuration, and the battery power source comprises two 1.5 volt pen-light battery cells.

The housing includes a battery compartment for containing the battery power source, and a lamp mounting cavity as well, for mounting the lamp unit therein. The lamp unit is mounted behind the housing surface permitting the passage of illumination therethrough, which is the preferred embodiment, is a light transmissive panel that is made of a translucent material. To effect desired focusing of light, the light transmissive panel is installed over the opening formed by the lamp mounting cavity in the housing. The plane of the glass panel is disposed at an acute angle with respect to the plane of the supporting base as to provide a directed beam of illumination onto the front panel of the hand-held remote control unit received within the rectangular space. To provide improved focusing of light, a focusing reflector can be installed behind the lamp means, within the lamp mounting cavity.

As a result of the present invention, a hand-held remote control unit of whatever variety can be attached to the illumination device hereof and thus be capable of intensely illuminating the front panel thereof bearing programming and function switches, that is, without interfering with the operation of the remote control unit itself, and without substantially altering the overall resulting dimensions thereof as to detract from its otherwise hand-holdable features. Thus, hand-held remote control units so equipped can be simply and conveniently operated in the darkest of viewing environments and without resorting to illuminating the entire video-viewing room as has been conventionally required hitherto.

Moreover, as the illumination device of the present invention conforms in great part to the pre-existing geometry of conventional hand-held remote control units, the illumination device can be turned "on" and "off" with the thumb of the operator, further ensuring that the unit can be simply energized and de-energized upon picking up and setting down, respectively, the hand-held remote control unit accommodatably received within the illumination device of the present invention.

DESCRIPTION OF THE DRAWINGS

For a further understanding of the objects of the present invention, reference is made to the following detailed description of the preferred embodiment which is to be taken in connection with the accompanying drawings, wherein:

FIG. 1 is a perspective view of the illumination device of the present invention, shown attached to the casing of a conventional hand-held remote control unit;

FIG. 1A is a fragmented cross-sectional view of the end of the support base of the illumination device, taken along line 1A—1A of FIG. 2;

FIG. 1B is a fragmented cross-sectional view of the ratchet mechanism of the preferred embodiment, taken along line 1B—1B of FIG. 2;

FIG. 2 is a perspective cross-sectional view of the illumination device of the present invention taken along line 1—1, without the hand-held remote control device;

FIG. 3 is an elevated side view of the preferred embodiment of the illumination device of the present invention;

FIG. 4 is an elevated cross-sectional partially cut-away view of the preferred embodiment of the illumination device of the present invention, showing the spring biased slidable inner side wall and the resiliently flexible biased end side wall with a conventional hand-held remote controlled unit accommodatably received therebetween;

FIG. 5 is a top plan partially cut-away view of the preferred embodiment of the illumination device, showing the slidably biased inner side wall thereof and the adjustment means including a ratchet mechanism;

FIG. 6 is a perspective view of an alternative embodiment of the illumination device of the present invention, showing an alternative adjustable mounting means therefor;

FIG. 11 is a perspective end side view of the housing of the illumination device hereof, showing the opening of the battery storage compartment with a battery cell being slidably removed therefrom with the battery compartment door in the open position; and FIG. 12 is a schematic diagram of the illumination means showing an on-off switch, two 1.5 V cells and three fuse-type incandescent lamps, all being connected together in a series configuration.

DETAILED DESCRIPTION OF THE PREFERRED EMBODIMENT

Figure 7:
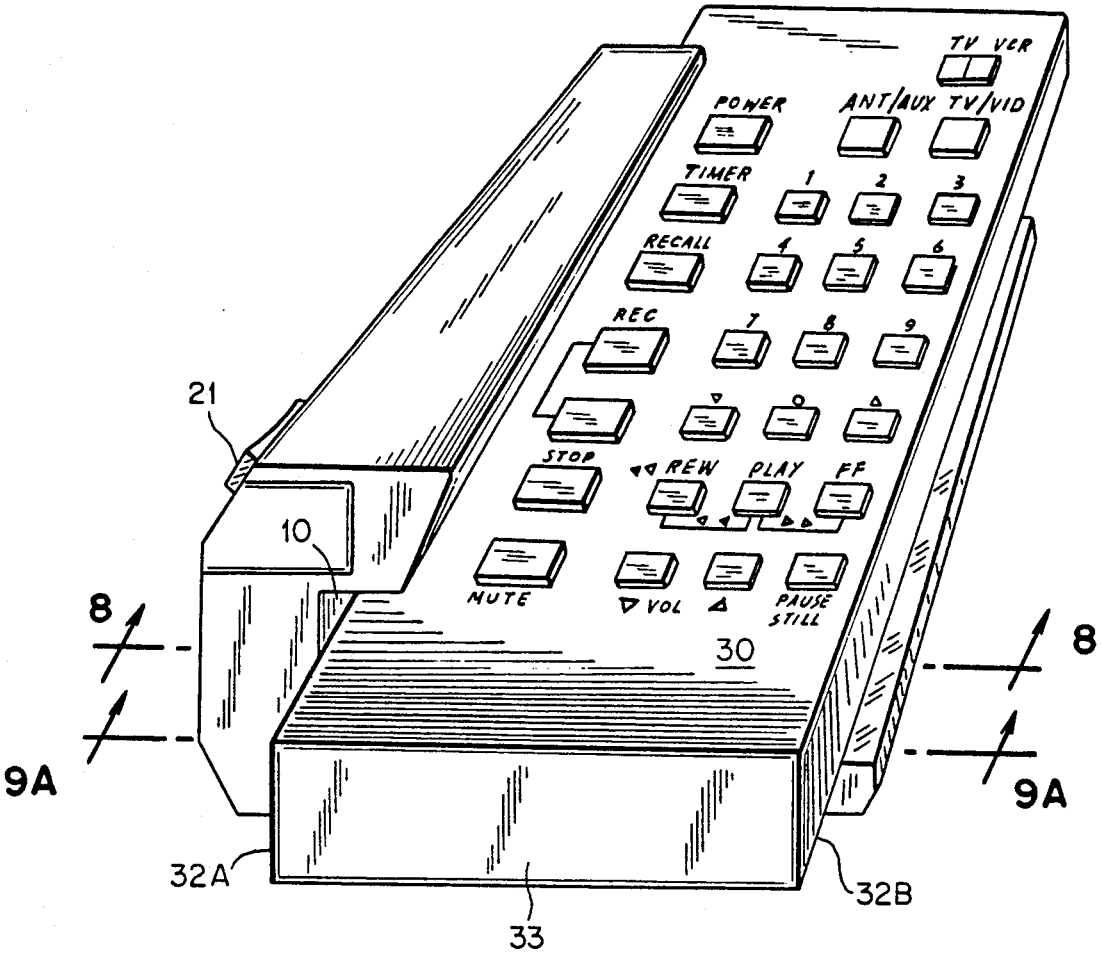
FIG. 7 is a perspective view of another embodiment of the illumination device of the present invention, shown attached to the casing of a conventional hand-held remote control unit.

Referring to FIGS. 1-6, 7, 9A and 10A in particular, the illumination device 1 of the present invention is shown generally comprising an illumination means 2, a base 3, and a projection 4 extending from the base 3. A conventional hand-held remote control unit, which is accommodatably received by the illumination device 1, is illustrated in FIGS. 1, 7, 9B and 10B, and typically includes a front panel 30 bearing a plurality of function, selection and programming switches, a front side panel 31 from which infrared signals are transmitted, a first and second side panel 32A and 32B, respectively, a rear side panel 33, and back panel 34.

As illustrated in FIGS. 1-6, 7-9A and, in particular, the projection 4 is exposed to a receiving space 5 formed by the base 3 and contains the illumination means 2 which is directed toward the receiving space 5. In general, the space 5 is configured to accommodate receipt of at least a portion of the hand-held remote control unit in the space 5, so that the hand-held remote control unit is received within the space 5 at a position to subject the front panel 30 to the illumination means 2 for facilitating illumination thereof while permitting actuation and operation of the hand-held remote control unit.

In the preferred embodiments hereof, the projection 4 and at least a portion of the base 3 comprises a housing 6 for containment of the illumination means 2, and at least a portion of the base 3 comprises a receiving means 7 for receiving the hand-held remote control unit within the receiving space 5. In general, the receiving means 7 includes a substantially planar support base 8 joined to the housing 6 and forms a housing support base subassembly having a distal end indicated by the arrow marked "D" and a proximal end indicated by the arrow marked "P".

In the embodiment illustrated in FIGS. 1-5, the support base 8 has a slidably adjustable end side wall 9 which is disposed substantially orthogonal thereto at the distal end. The support base 8 also has a slidable inner end wall 10 which is orthogonally disposed at the proximal end. The slidable inner end wall 10 is biased in the direction towards the end side wall 9, and preferably a spring or other biased urging means 11 is used to achieve the same.

The inner end wall 10 is realized by a rectangular shaped tube 12 having a longitudinally-disposed slot 13 formed along the side wall opposite the inner side wall 10 which abuts against one of the side panels of the hand-held remote control unit. The housing 6 has a lower side portion 14 from which a pair of spring mounting posts 15A and 15B project. Spring means 11 are disposed about each respective spring mounting post 15A and 15B and the posts insert through the slot 13 formed in the rectangular shaped tube 12 and each has an end flange 16 to prevent the posts from retracting out from the tube 12. The width of the rectangular shaped tube 12 is selected so that the tube 12 can slide about the flanges 16 under the biasing force of the spring means 11 so that the spacing between the inner side wall 10 and the end side wall 9 can be adjusted by applying sufficient force to overcome the biasing force of the spring means 11.

In the embodiment shown in FIGS. 1-5, in particular, the configuration of the slidable, spring-biased inner side wall 10, slidably adjustable end side wall 9, and support base 8 together form a rectangular "receiving" space or channel 5 of variable dimensions, whereinto the hand-held remote control unit can be accommodatably received and securely held. In this embodiment as well, the slidably adjustable end side wall 9 is made of a flexible resilient material, such as rubber, and is disposed at a small angle slightly less than 90° from the supporting base as illustrated in FIG. 4 in particular. This construction provides an advantageous clamping action on and against the adjacent side panel of the hand-held remote control unit as it is accommodatably received within the rectangular space 5.

Referring to FIGS. 2, 4 and 5 in particular, the receiving means 7 is clearly illustrated as well as the means by which the end side wall 9 is slidably adjustable with respect to the biased inner side wall 10, in the preferred embodiment. In this embodiment of the present invention, the receiving means 7 includes an adjustment means comprising the support base 8 having a first planar member 8A and a second planar member 8B. The first planar member 8A is joined to the inner side wall 10 and/or housing 6, and the second planar member 8B is joined to the end side wall 9 by conventional means known in the art. As illustrated in FIG. 1A, the opposing side edges of the second planar member 8B are slidably received into respective guide channels 26 formed in the first planar member 8A, and the first and second planar members 8A and 8B are maintained in relative adjusted position by a locking means realized in the embodiment of FIGS. 1-5, by a ratchet mechanism 27.

The ratchet mechanism 27 of this embodiment is illustrated in FIGS. 1B, 4 and 5 in particular, and includes a first ratchet surface 28 and a second ratchet surface 29 disposed on first and second planar members 8A and 8B, respectively. Notably, the ratchet surfaces 28 and 29 are arranged on the first and second planar surfaces 8A and 8B, in order to provide adjustable relative interlocking of the first and second planar members 8A and 8B over a range of positions suitable to accommodate the variety of widthwise dimensions of any particular hand-held remote control unit interposed between the biased inner side wall 10 and the slidably adjustable end side wall 9.

Specifically, the first ratchet surface 28 comprises a plurality of teeth, and is centrally located on the top surface of the first planar member 8A, and runs from the edge thereof toward the proximal end of the illumination device, as shown in FIG. 5. The second ratchet surface 29 also comprises a plurality of teeth which are centrally located on the edge of the bottom surface of the second planar member 8B. Notably, the mating teeth of the first and second ratchet surfaces 28 and 29 are configured so that the second planar member 8B can be easily slid towards the inner side wall 10 with an incremental locking action achieved by the relative sliding movement between the engaging surfaces of the mating teeth. This incremental locking action facilitates incremental adjustment of the widthwise dimensions of the receiving channel 5, as the end side wall is pushed towards the inner side wall 10. With the ratchet mechanism 27 of the preferred embodiment, the second planar member 8B is prevented from sliding out from the first planar member away from the proximal end of the illumination device, since the mating teeth prevent such movement. However, in order to release the ratchet mechanism 27 from its locked position, all that is required is to lift up on the outer end of the second planar member 8B, near the end side wall 9. As a result of (a) proper tolerances provided between (i) respective guide channels 26 of the first planar member 8A and (ii) the side edges of the second planar member 8B slidably received therewithin and (b) resilient deflection across the second planar member 8B, there is sufficient clearance for the teeth of the second ratchet surface 29 to lift out of and clear above the first ratchet surface 28 while the distal end of the second planar member 8B is lifted upwardly, so that the second planar member 8B and attached side end wall 9 can be slidably moved away from the inner side wall 10, thereby expanding the widthwise dimensions of the receiving space 5.

Referring to FIG. 6, there is shown an another embodiment of the illumination device of the present invention which, while having many of the structural and functional features of the illumination device shown in FIGS. 1-5, differs in the following respects. Therein, the receiving means 7 includes an adjustment means comprising support base 8 having a first planar member 8A and a second planar member 8B joined in a manner described hereinabove. In this alternative embodiment, however, besides being slidably received into one another, one of the first and second planar members 8A and 8B is biased, for example, by spring means 17, so that the end side wall 9 is forced to slidably move in the direction towards the inner side wall 10 under a spring-loaded biasing force. In addition, the biasing means on the inner side wall 10 can be eliminated from this embodiment, to provide a slight longitudinal recess 18 below the projection 3 of the housing 4, under which the edge portion of the hand-held remote control unit can be received.

Figure 8:
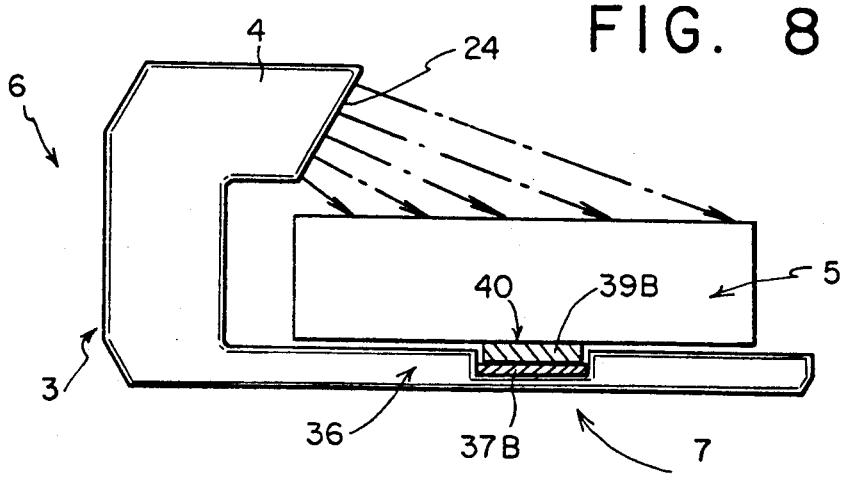
FIG. 8 is an elevated cross-sectional view of the illumination device of FIG. 7 taken along line 8—8 of FIG. 7.
Figure 9B:
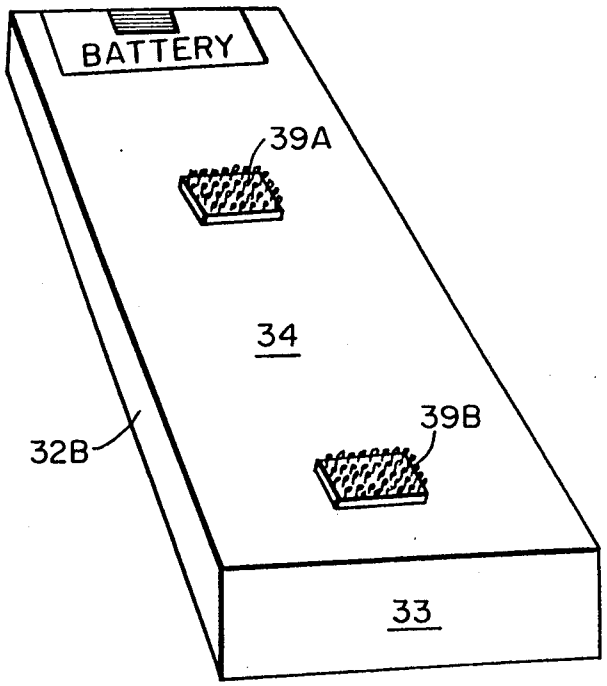
FIG. 9B is a perspective view of the conventional hand-held remote control unit illustrated in FIG. 7, showing the back panel thereof bearing a pair of spaced apart loop-type structures positioned so as to insert within the recesses of the planar support structure shown in FIG. 9A, and releasably attach to a mating hook-type structure contained a respective recess.
Figure 9A:
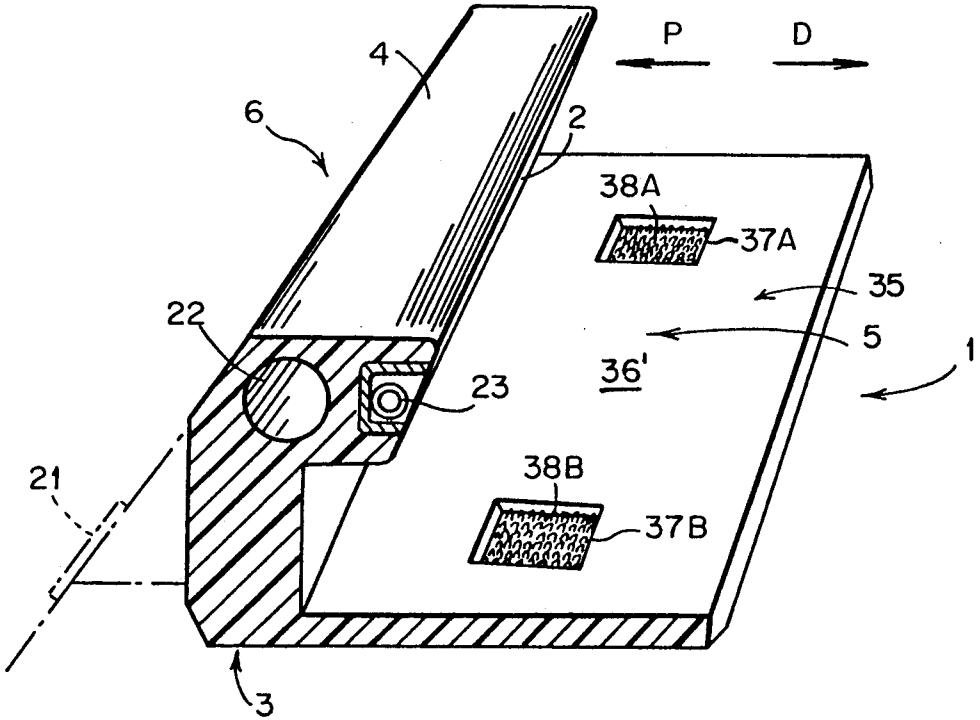
FIG. 9A is a perspective cross-sectional view of the illumination device taken along line 9A—9A of FIG. 7, with the hand-held remote control unit removed from the substantially planar support structure, exposing the pair of spaced apart recesses each containing hook-type structures disposed therein.

Referring now to FIGS. 7, 8, 9A and 9B, there is shown yet another embodiment of the illumination device of the present invention. As illustrated in FIGS. 7, 8 and 9A, in particular, the illumination device of the present invention generally comprises an illumination means 2, a base 3, and a projection 4 extending from the base, as illustrated in the embodiments of FIGS. 1-6, for example. In a similar manner as to that illustrated in FIGS. 1-6, in particular, the projection 4 is exposed to a receiving space 5 above the base 3 and contains the illumination means 2 which is directed toward the receiving space 5. Also, the illumination device of this embodiment comprises an attachment means 35 for releasably attaching at least a portion of the panel 34 of the hand-held remote control unit to at least a portion of said base 3. This releasable attachment of the back panel 34 to a portion of the base 3 is so that, in principle, at least a portion of the length and width and the entire height of the hand-held remote control unit is maintained in a position within the space 5 above the base 3, so as to subject a selected surface of the front control panel 30 to the illumination means for facilitating illumination of the selected surface by reflecting light rays therefrom, while permitting actuation and operation of the hand-held remote control unit.

In the embodiment of the present invention shown in FIGS. 7, 8, 9A and 9B, the projection 4 and at least a portion of the base 3 comprises a housing 6 for containment of the illumination means 2. As in the hereinbefore described embodiments, the housing 6 also has a surface permitting the passage of illumination from the illumination means 2 through the surface, and at least a portion of the base 3 is capable of receiving the hand-held remote control unit in the receiving space 5. In this embodiment of the present invention, the base 3 comprises a substantially planar support structure 36 having a pair of spaced apart rectangular recesses 37A and 37B, each of predetermined depth "d". In accordance with the present invention, in order to maintain the hand-held remote control unit in a position within the receiving space 5 above the planar support structure 36', the attachment means 35 of this particular embodiment comprises two Velcro® brand fastening devices each having releasably mating hook and loop-type structures 38A, 38B and 39A, 39B, respectively. The rectangular-shaped hook-type structures 38A is securely mounted into its respective rectangular recess 37A, whereas rectangular hook-type structures 38B is securely mounted into its respective rectangular recess 37B as shown in FIG. 9A, in particular. Securement of the rectangular hook-type structures 38A and 38B into respective recesses 37A and 37B, respectively, can be achieved using an adhesive such as silicon rubber, however, one of a variety of conventional adhesives may be used with excellent results.

In order to properly locate the matching rectangular loop-type structures 39A and 39B on the back panel 34 of the hand-held remote control unit shown in FIG. 9B, the following procedure can be employed.

Rectangular loop-type structures 39A and 39B are placed into the respective recesses 37A and 37B formed in the substantially planar support structure 36' so that each mating loop structure releasably attaches to its respective hook structure in a manner well known in the releasable fastener art. In this "releasably attached" condition, the upper surface of each loop structure 39A and 39B will extend slightly out from its respective recess, and lie slightly above the substantially planar support structure 36. To ensure this condition, the thickness of each releasably attached hook and loop structure should be slightly greater than recess depth "d". Then, a pre-applied adhesive 40 on the back of each rectangular loop structure 39A and 39B, is exposed by pealing off a protective layer of material, thereby exposing a highly tacky adhesive layer 40.

To these tacky adhesive layers 40, selected portions of the flat back panel 34 of the hand-held remote control unit can be made to adhere, by simply placing the back panel 34 of the hand-held remote control unit flat upon the substantially planar support structure 36 within the receiving space 5 lying thereabove. Thus, with the protective layers pealed off from respective loop-type structures 39A and 39B, the adhesive layers 40 will lie slightly above planar support structure 36 so that the selected portions of back panel 34 adhere to the exposed adhesive layers 40 and bond securely thereto, upon pushing the hand-held remote control unit downwardly onto the planar support structure 36.

In order to ensure proper placement of the loop-type structures 39A and 39B on the back panel 34, it has been found best to turn on the illumination means 2 so that the light rays radiate over the central-most portion of the front control panel 30. In this position, at least a portion of the length and width and the entire height of the hand-held remote control unit will be maintained in a position within the space 5 above the base so as to illuminate the selected surface of the front control panel 30 of the hand-held remote control unit.

While the attachment means 35 of the preferred embodiment has been realized using Velcro® type fastening devices, other fastening devices may be used as well, within the scope of the present invention. For example, rectangular magnetic plates may be securely mounted into the lower portion of each recess 37A and 37B formed in the substantially planar support structure 36, and iron-containing (i.e. ferric-containing) plates of dimensions suitable to fit within the recesses, can be applied to the back panel 34 of the hand-held remote control unit by way of an adhesive layer applied to one side of each iron-containing plate. In such an embodiment, each iron-containing plate preferably would have on one of its faces, a pre-applied adhesive layer covered by a protective layer which can be pealed off to expose the pre-applied adhesive as desired prior to mounting the iron-containing plates to the back panel 34 of the hand-held remote control unit. The magnetic elements can be realized as rectangular thermoplastic elements embodying magnetic particles in a manner well known in the magnet art. Notably, the magnetic elements can be securely mounted in the recesses 37A and 37B by a conventional adhesive.

Figure 10B:
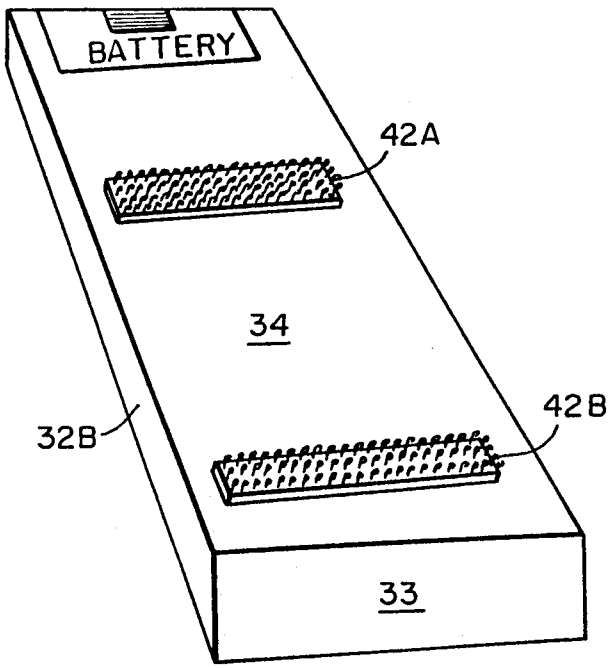
FIG. 10B is a perspective view of the conventional hand-held remote control unit, showing the underside panel thereof bearing a pair of spaced apart loop-type structures positioned so as to releasably attach to the hook elements disposed on the support panel of the illumination device shown in FIG. 10A.
Figure 10A:
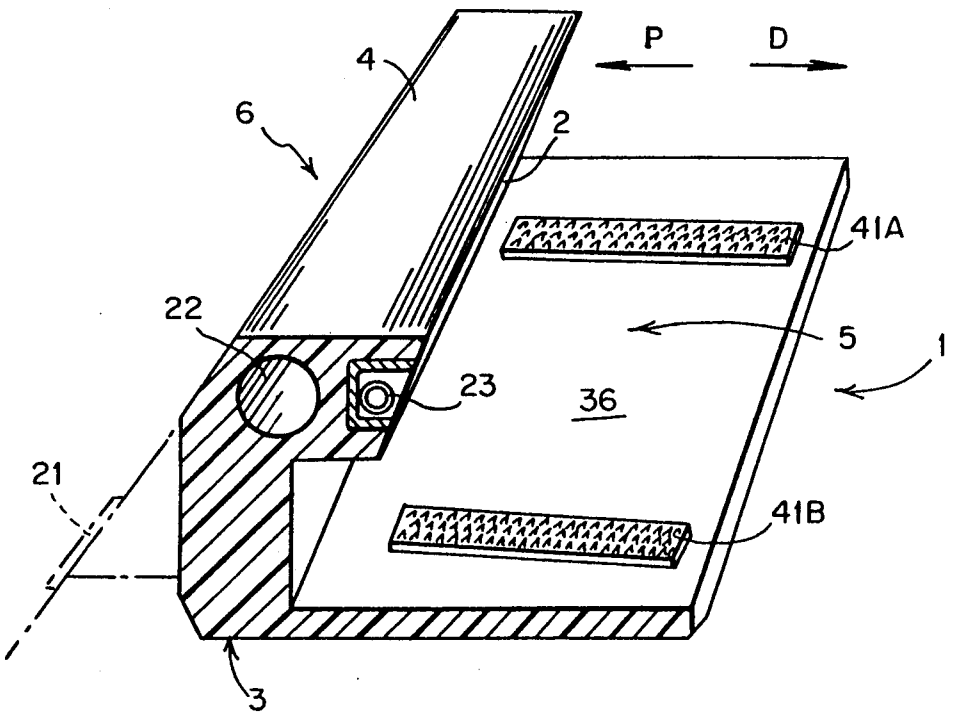
FIG. 10A is a perspective cross-sectional view of yet another embodiment of the illumination device of the present invention showing the base realized as a substantially planar support structure and bearing a pair of spaced apart rectangular shaped hook-type structures securely disposed in the widthwise dimension of the planar support structure.

In yet another embodiment shown in FIGS. 10A and 10B, the releasable attachment means 41A, 41B, 42A, 42B comprise two pairs of rectangularly-shaped Velcro® type fastening devices each having a hook-type structures or a loop-type structure. These hook-type structures 41A and 41B are mounted in a spaced-apart parallel manner, running along either the widthwise or lengthwise dimension of the planar support structure 36, as shown in FIG. 10A. In this embodiment, the use of recesses in the substantially planar support structure 36 is avoided. However, this embodiment will typically require either more Velcro® fastening material and/or low-relief "feet" attached on the corners of the back panel 34, in order to prevent wobbling of the hand-held remote control unit on the planar support structure 36. In addition, according to such an embodiment, the attachment means 35 can be realized using pairs of magnetic and iron-containing strips, in a similar manner described above.

Referring to FIGS. 2, 11 and 12, the illumination means 2 of the preferred embodiments of the illumination device hereof, will now be described. In general, the illumination means comprises a battery power source 19, a lamp unit 20, and an on-off switch 21, with the battery power source 19, lamp unit 20 and switch 21 being connected in a series configuration. The lamp unit 20 comprises three fuse-type incandescent bulbs connected in series configuration, and the battery power source 19 comprises two 1.5 volt pen-light (e.g. AA type) battery cells connected in series. The bulbs, while having a long operation life, can be replaced, and the batteries can be of the disposable or rechargeable type. The switch 21 is mounted on the upper end of the outer side wall 14 of the housing 6 in a position which is aligned with the operator's thumb when the illumination device 1 is held in his or her hand as would be the remote control unit, as well.

Referring to FIG. 11, the end of the housing 6 is shown. As illustrated, the housing includes a battery compartment 22 for containing the battery cells 19, and a lamp mounting cavity 23 as well, for mounting the lamp unit 20 therein. The lamp unit 20 is mounted behind a housing surface 24 permitting the passage of radiant illumination therethrough. In the preferred embodiment, the light-transmissive housing surface 24 is a light-transmissive panel that is made of a translucent material, such as glass or plastic, which snaps into an appropriately formed groove formed in the outer defining perimeter of the lamp mounting cavity 23. A longitudinally concave or parabolic reflector 25 is mounted in the lamp mounting cavity 23, behind the lamp unit 20, and serves to focus or otherwise concentrate radiant illumination in a direction perpendicular to the plane of the light-transmissive panel 24. In order to replace any one or more of the fuse-type incandescent bulbs 20, the light transmissive panel 24 is simply pried off from the front of the lamp mounting cavity 23, the old bulb removed from its mounting socket, and a new bulb inserted therewithin.

To effect efficient illumination of the front panel of the hand-held remote control unit, the plane of the glass panel 24 is disposed at an acute angle with respect to the plane of the supporting base 8, as illustrated in FIG. 3. This is further achieved by the projection 4 of the housing 6 (containing the lamp mounting cavity 23), being slightly canted or tipped in the direction towards the front panel 30 of the remote control unit, as illustrated in FIGS. 3 and 4 in particular. With such a housing configuration, a beam of intensely focused illumination can be simply and effectively directed onto the front panel 30 of the remote control unit that is accommodatably received in the variable rectangular space 5 of the illumination device 1.

It is contemplated that modification to the illumination device 1 hereof would involve making the projection 4 (containing the illumination means 2), adjustable with respect to the base 3. This could involve joining the projection 4 to the base 3 by a hinge means, thereby providing variable angular adjustment of the beam of illumination with respect to portions of a remote control unit to be illuminated.

While the particular embodiments shown and described above have been proven to be useful in many applications involving the hand-held remote control arts, further modifications of the present invention herein disclosed will occur to persons skilled in the art to which the present invention pertains and all such modifications are deemed to be within the scope and spirit of the present invention defined by the appended claims.

What is claimed is:

1. An illumination device for use with a hand-held remote control unit having a length, width and height and a back panel and a front control panel, said illumination device comprising:

a base and a projection extending from and projecting above said base and being exposed to a space formed above said base;

said projection containing illumination means capable of producing light rays directed toward said space; and attachment means for releasably attaching at least a portion of the back panel of a hand-held remote control unit to at least a portion of said base so that at least a portion of the length and width and the entire height of the hand-held remote control unit is maintained in a position within said space above said base so as to subject a selected surface of the front control panel to said illumination means for facilitating illumination of the selected surface by reflecting light rays therefrom, while permitting actuation and operation of the hand-held remote control unit.

2. The illumination device of claim 1, wherein said projection and at least a portion of said base comprises a housing for containment of said illumination means, said housing having a surface permitting the passage of illumination from said illumination means therethrough.

3. The illumination device of claim 2, wherein said base comprises a substantially planar support structure joined to said housing and having a distal end and a proximal end, said support base further having an inner end wall orthogonally disposed at said proximal end.

4. The illumination device of claim 2, wherein said receiving means comprises:

at least one fastening device attached to a portion of said substantially planar support structure.

5. The illumination device of claim 4, wherein said fastening device comprises a strip of hook-type material securely attached to said portion of said substantially planar support structure.

6. The illumination device of claim 1, wherein said illumination means comprises:

a battery power source, a lamp unit, and an off-on switch, said battery power source, lamp unit and switch being connected in a series configuration.

7. The illumination device of claim 2, wherein said illumination means comprises a battery power source, a lamp unit, and an on-off switch, said battery power source, lamp unit and switch being connected in a series configuration.

8. The illumination device of claim 7, wherein said housing includes:

a battery compartment for containing said battery power source, and a lamp mounting cavity for mounting said lamp unit therein, said lamp unit being mounted behind said surface permitting the passage of said illumination therethrough.

9. The illumination device of claim 8, wherein said passage comprises:

a light transmissive panel installed over an opening formed by said lamp mounting cavity in said housing, the plane of said light transmissive panel being disposed at an acute angle with respect to the plane of said base as to provide a directed beam of illumination towards said space.

10. The illumination device of claim 9, wherein said light transmissive panel is made of translucent material.

11. The illumination device of claim 10, wherein said lamp unit comprises three fuse-type incandescent bulbs connected in series configuration, and said battery power source comprises two 1.5 volt pen-light battery cells.

12. An assembly for releasably securing and illuminating a hand-held electronic device, comprising:

a base;

a projection extending from and projecting above said base and being exposed to a space formed above said base;

said projection including illumination means capable of producing light rays directed toward said space;

a hand-held electronic device having a length, width and height and a back panel and a front panel, said device further including electronic controls;

attachment means releasably securing at least a portion of said device to at least a portion of said base so that said device may be at least partially illuminated by light rays produced by said illumination means, said electronic controls being accessible for actuation and operation of said device; and said space being configured to accommodate receipt of at least a portion of the length and width and the entire height of said device.

13. An assembly as described in claim 12 wherein said base includes a pair of opposing end walls, said device being positioned between said end walls along at least part of its length.

14. An assembly as described in claim 13 wherein said device is engaged by said opposing end walls and thereby securely mounted to said base.

15. An assembly as described in claim 14 wherein said illumination means include a lamp unit, said assembly further including a battery power source and a switch connected in series with said lamp unit.

16. An assembly as described in claim 14 wherein said front panel of said device is positioned so as to be at least partially illuminated by said illumination means.

17. An assembly as described in claim 16 wherein said front panel of said device includes said electronic controls.

18. An assembly as described in claim 17 wherein said device is a remote control unit.

19. An assembly as described in claim 14 wherein at least one of said end walls is deflectable upon engagement with said device.

20. An assembly as described in claim 12 including means for releasably securing said back panel of said device to said base.

* * * * *